United States Patent [19]

Stepantsov et al.

[11] 4,166,374

[45] Sep. 4, 1979

[54] HIGH-SPEED EXPLOSION HAMMER

[76] Inventors: Georgy K. Stepantsov, ulitsa Belinskogo, 21, kv. 36, Kazan; Jury N. Bloschitsyn, Yasenevo, mikroraion 1, korpus 1, podiezd 3, kv. 141, Moscow; Alexandr A. Babko, ulitsa Sotsialisticheskaya, 3, kv. 20, Kazan; Ferdinand K. Kutlin, ulitsa Mirnaya, 61, kv. 75, Kazan; Ivan V. Glazunov, ulitsa Serova, 35, kv. 136, Kazan, all of U.S.S.R.

[21] Appl. No.: 878,460

[22] Filed: Feb. 16, 1978

[51] Int. Cl.[2] ..... B21J 7/26

[52] U.S. Cl. ..... 72/430

[58] Field of Search ..... 72/430, 453.1; 29/421 E; 173/134; 60/638, 632

[56] References Cited

U.S. PATENT DOCUMENTS

| | | | |
|---|---|---|---|
| 2,202,125 | 5/1940 | Temple | 72/430 |
| 3,044,452 | 7/1962 | McCrory | 173/134 |
| 3,552,181 | 1/1971 | Chan | 72/453.1 |
| 3,827,278 | 8/1974 | Mershon | 72/430 |
| 3,931,726 | 1/1976 | Grubb | 29/421 E |

*Primary Examiner*—Charlie T. Moon
*Assistant Examiner*—Gene P. Crosby
*Attorney, Agent, or Firm*—Fleit & Jacobson

[57] ABSTRACT

The invention relates to metal forming equipment. In the hammer according to the invention, an explosion device is provided with a check valve to establish communication of the inner space of the casing of the explosion device with the explosion chamber and to close the explosion chamber after a blow-up of granular explosive. The casing of the explosion device is mounted in a load-bearing frame for axial adjustment to vary the volume of the explosion chamber. This construction enables the amount of charge of granular explosive, hence the impact energy of blow of the upper die against the blank to be varied over a wide range thus resulting in considerable enlargement of manufacturing capabilities of the hammer.

6 Claims, 1 Drawing Figure

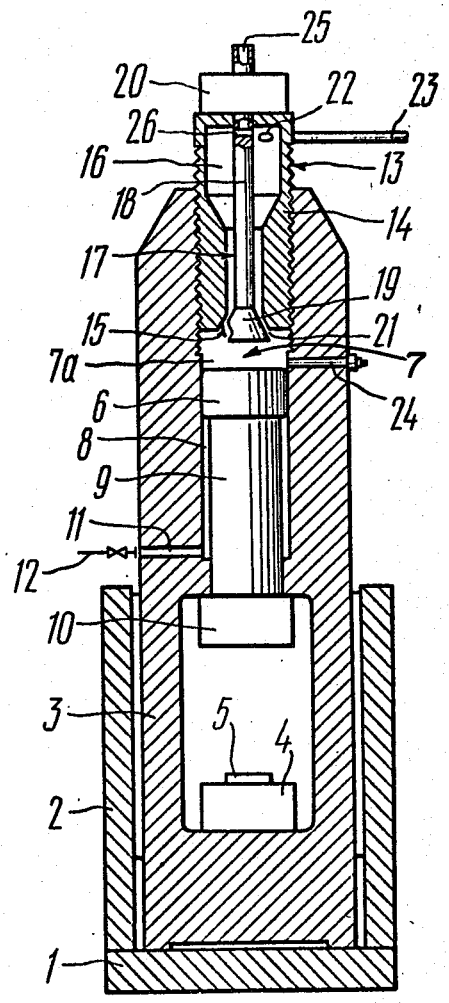
25
20
22
23
26
16
13
18
14
17
19
15
21
7a
7
6
24
8
9
11
12
10
3
5
4
2
1

HIGH-SPEED EXPLOSION HAMMER

FIELD OF THE INVENTION

The invention relates to metal forming equipment, and more particularly to high-speed explosion hammers.

The invention may be most advantageously used for the manufacture of a large variety of parts of different size, such as compressor and turbine blades.

BACKGROUND OF THE INVENTION

Known in the art are high-speed explosion hammers having a stationary bed incorporating a load-bearing frame supporting a lower die to receive a blank, and, mounted in the upper portion of the frame, a piston having a piston rod supporting an upper die coaxial with the lower die and an explosion device arranged over the piston in such a manner that the upper piston chamber defines the explosion chamber.

The explosion device of prior art hammers is made in the following manner. A sleeve is rigidly fixed to the upper portion of the load-bearing frame to receive a cartridge with a powder charge and an igniter pellet. The cartridge is locked in the sleeve by means of a wedge arrangement. A trigger and percussion assembly is provided for firing impression of the pellet and for igniting the powder charge of the cartridge. The explosion device is also provided with a cartridge magazine.

In order to provide optimum conditions for the manufacture of high-grade parts, the upper die should be given pre-set velocity and impact energy. These values depend on strength and ductility of the material of the blank being treated, as well as on the shape and size of a part.

Impact energy required at a given impact velocity may be achieved by selecting appropriate amount of powder charge and volume of the explosion chamber. It is, however, practically impossible to substantially change the amount of charge in prior art hammers since the charge is of a predetermined size. A change in size of the cartridge for changing the amount of charge requires replacing a number of parts and assemblies of the explosion device, such as the sleeve, the wedge arrangement, the cartridge magazine. Therefore, prior art hammers are designed for a pre-set size of blanks so that the manufacturing capabilities of a hammer are limited.

Besides, an increase in air humidity may result in the igniting pellet and powder becoming damp thus leading to the failure of the explosion device to operate and making the hammer unreliable in operation.

For charging the cartridges with powder, wads, such as cardboard wads are used which remain in the explosion chamber after the blow-up to contaminate it. Removing the wads presents certain problems.

OBJECTS OF THE INVENTION

The main object of the invention is to enlarge the manufacturing capabilities of a high-speed explosion hammer.

Still another object of the invention is to improve reliability of the hammer.

These and other objects are accomplished by that in a high-speed explosion hammer comprising a stationary bed incorporating a load-bearing frame supporting a lower die receiving a blank and, mounted in the upper portion of the load-bearing frame, a piston having a piston rod supporting an upper die coaxial with the lower die, and an explosion device arranged over the piston in such a manner that the upper piston chamber defines the explosion chamber, according to the invention, the explosion devices comprises an axially adjustable hollow casing in the form of a sleeve having an open end thereof defining the explosion chamber provided with an igniter for explosive, and the inner space of the sleeve accommodates a check valve to establish communication of this inner space with the explosion chamber to admit thereto an explosive fed along a conduit and to close the explosion chamber upon a blow-up which is effected by applying voltage to the igniter.

This construction enables variation of the volume of the explosion chamber and the admission of granular explosive in a pre-set amount directly to the explosion chamber thus providing for variation of the amount of charge over a large range, hence for variation of kinetic energy imparted to the upper die over a large range to obtain a pre-set impact energy. Thus an opportunity is offered for treating parts of different size on a single hammer, whereby the manufacturing capabilities of the hammer according to the invention are enlarged. The provision of the igniter in the explosion chamber ensures a positive ignition of an explosive, hence the reliability of the hammer in operation is improved.

The valve is preferably made in the form of a rod coaxially mounted in the casing and having one end extending through a hole made in the bottom wall of the casing and the other end provided with a conical head defining, with a chamfer provided on the open end of the casing, an annular space for establishing communication of the inner space with the explosion chamber which is closed when the rod is lifted.

It is also advantageous that, in order to establish communication of the inner space of the casing with the conduit for feeding granular explosive, a through hole be provided in the wall of the casing adjacent the bottom wall thereof to extend tangentially to the inner cylindrical surface of the casing, the profile of the inner space being stepped in the axial section, and a portion of the profile adjacent the bottom wall of the casing being of a diameter which is substantially greater than the diameter of a portion adjacent the open end of the casing.

This construction results in that the stream of granular explosive is swirled in the inner space, and gas is separated therefrom since particles of explosive, such as powder, are thrown by centrifugal forces against the casing wall and fall down under gravity.

According to the invention, the end of the rod extending through the hole in the bottom wall of the casing is made with an axial bore and a radial bore communicating with each other to establish communication of the inner space of the casing with atmosphere and to remove the gas with which the explosive is admitted to the inner space, as well as explosive combustion products from the inner space.

A specific embodiment of the invention as applied to a high-speed explosion hammer will be described with reference to the accompanying drawing which shows a vertical section of the high-speed explosion hammer according to the invention.

The high-speed explosion hammer comprises a stationary bed 1 which is rigidly fixed to a foundation (not shown). The bed 1 has guides 2 in which a load-bearing frame is mounted in a known manner. A lower die 4 accommodating a blank 5 is mounted on the lower portion of the load-bearing frame 3. The upper portion of the load-bearing frame 3 has a cylindrical inner space accommodating a piston 6 (as shown in the drawing) which defines a upper piston chamber 7 and an lower piston chamber 8 in the inner space. The piston 6 has a piston rod 9 having its free end supporting an upper die 10. The upper die 10 is arranged coaxially with the lower die.

The lower piston chamber 8 communicates with an air line 12 through an opening 11 to be filled with gas under pressure and to hold the piston 6 and the piston rod 9 and upper die 10 in the initial upmost position. An explosion device 13 is mounted in the upper portion of the load-bearing frame 3 in such a manner that the upper piston chamber 7 defines the explosion chamber of the device. The explosion device comprises a casing 14 in the form of a sleeve. The casing 14 is axially adjustable in the frame 3 by means of a thread. The open end of the casing 14 faces the explosion chamber 7*a* to define it at the top. The open end of the casing 14 is internally provided with a chamfer 15. The profile of the inner space 16 of the casing 14 is stepped. A portion of this profile adjacent the bottom wall of the casing 14 is of a diameter which is substantially greater than the diameter of its portion adjacent the open end of the casing 14 (as shown in the drawing). It should be noted that a conjugation surface between greater and smaller diameters is conical. The taper does not exceed 90°. The explosion device 13 is provided with a check valve 17. The check valve 17 comprises a rod 18 having at the end thereof a conical head 19. The rod 18 is mounted in the inner space 16 of the casing 14 coaxially therewith so that the head 19 mates, with its conical surface, with the chamfer 15.

The conical surface of the head 19 and the chamfer 15 of the casing 14 are inclined at the same angle to the axis of the rod 18, and their surfaces are lapped.

A central hole is made in the top wall of the casing 14, and the other end of the rod 18 extends through this hole. The rod 18 is axially movable by means of a drive 20 of any appropriate type. The drive 20 is mounted to the casing 14 as shown in the drawing.

In the lowermost position of the rod 18, a space 21 is formed between the conical head 19 thereof and the chamfer 15 of the casing 14 to establish communication of the inner space 16 with the explosion chamber 7*a*.

A through hole 22 is made in the wall of the casing 14 adjacent the top wall thereof to extend tangentially to the cylindrical surface of the inner space 16. The hole 22 is designed to establish communication of the inner space 16 with a conduit 23 for feeding granular explosive, such as powder. An electric igniter 24 for igniting powder is built in the load-bearing frame 3 above the piston 6 in its upmost position (as shown in the drawing).

The end of the rod extending through the top wall of the casing 14 is made with an axial bore 25 and a radial bore 26 communicating with each other as shown in the drawing. The bores 25 and 26 are designed for discharging compressed gas used for feeding powder to the explosion chamber 7*a*, into atmosphere.

Moreover, the bores 25 and 26 are also designed for removal of powder combustion products.

The high-speed explosion hammer functions in the following manner.

In the initial position, the piston 6 and the piston rod 9 supporting the upper die 10 are in the upmost position under the action of compressed gas pressure in the lower piston chamber 8 which is in permanent communication with the air line 12.

The rod 18 is lowered by means of the drive 20 to open the check valve 17 and to form an annular space 21 between the conical head 19 of the valve 17 and the internal chamfer 15 of the casing 14. A batch of powder is admitted to the inner space 16 along the conduit 23 by means of compressed gas. The stream of compressed gas with powder flows within the inner space 16 tangentially to the cylindrical surface thereof and is swirled into a vortex flow. Thus, particles of powder which are heavier than the gas are thrown by centrifugal forces against the wall of the casing 14 and fall down under gravity. Powder enters the explosion chamber 7*a* through the space 21.

Compressed gas is discharged into atmosphere through the bores 25 and 26 provided in the end of the rod 18. After the batch of powder has been admitted to the explosion chamber 7*a*, the drive 20 is put on. The rod 18 is lifted to the upmost position to close the space 21. The conical head 19 intimately engages the chamfer 5, and the explosion chamber 7*a* is closed.

After that, a preheated blank 5 is placed in the lower die 4.

A voltage is applied to the electric igniter 24 to ignite the powder. A blow-up occurs. Powder gases formed in the chamber 7*a* act on the upper end of the piston 6. Under the action of powder gas pressure, the piston 6 and the piston rod 9 supporting the upper die 10 are caused to move towards the blank 5. The upper die 10 deforms the blank 5, whereafter the upper die 10 is stopped in the lowermost position.

The drive 20 is then reversed, and the rod 18 is lowered to open the valve 17. Powder combustion products leave the explosion chamber 7*a* through the inner space 16 and the bores 25 and 26 into atmosphere. Pressure in the explosion chamber 7*a* drops.

The piston 6, the piston rod 9 and the upper die 10 are lifted to the upmost position under the action of compressed gas pressure in the lower piston chamber 8 which is in permanent communication with the air line 12. Treated part is removed from the lower die 4. The operation cycle of the hammer is over, and the next cycle is repeated as described above.

In case the amount of powder charge is changed, the volume of the explosion chamber 7*a* should also be changed. For that purpose, the casing 14 is screwed in or out in the threaded hole of the load-bearing frame 3 to reduce or increase the volume of the explosion chamber 7*a*, respectively.

It should be noted that the field of application of this invention is not limited to the above-described embodiment.

While only one specific embodiment of the invention has been described, it will be apparent that various modifications and additions may be made in the structural members disclosed above and shown in the drawings without deviating from the spirit and scope of the claims.

We claim:

1. A high-speed explosion hammer comprising: a stationary bed; a load-bearing frame mounted in said stationary bed; a lower die mounted in said load-bearing frame to accomodate a blank; a piston installed in the upper portion of said load-bearing frame and having a piston rod with a free end thereof facing the lower die; an upper die arranged coaxially with said lower die at the free end of said piston rod; an explosion device arranged over said piston in an upper portion of said load-bearing frame for causing said piston with the upper die to move during the treatment of the blank; an upper piston chamber defining an explosion chamber of said explosion device; an igniter of explosive mounted in the explosion chamber; a hollow casing of said explosion device having the form of a sleeve mounted in said frame for axial adjustment and having an open end defining the explosive chamber; an inner space of said casing being communicatable with said explosion chamber; a check valve in said inner space for establishing communication thereof with said explosion chamber during the admission thereto of granular explosive fed along a conduit and for closing the chamber upon a blow-up which is effected by application of voltage to the igniter.

2. A hammer according to claim 1, wherein said check valve comprises a rod mounted coaxially in said casing of said explosion device, said rod having a conical head at the end of the rod facing said explosion chamber; a hole made in the top wall of said casing; the other end of the rod extending through the hole; a chamfer made at the open end of said casing of said explosion device; an annular space defined by said conical head and said internal chamfer; said annular space establishing communication of said inner space of said casing with said explosion chamber which is closed when the rod is lifted.

3. A hammer according to claim 1, wherein said casing has an axially-extending inner cylindrical surface and wherein a through hole is formed in the wall of said casing adjacent its top wall to extend tangentially to the inner cylindrical surface of said casing, the profile of said inner space being stepped in the axial section, and a portion of said profile adjacent the top wall of said casing being of a diameter which is substantially greater than the diameter of a portion thereof adjacent the open end of said casing.

4. A hammer according to claim 2, comprising: an axial bore made in the end of said rod extending through said hole of the top wall of said casing; a radial bore made in the end of said rod extending through said hole in the top wall of said casing and establishing communication between said axial bore and said inner space of said casing.

5. A hammer according to claim 2, wherein said casing has an axially-extending inner cylindrical surface and wherein a through hole is formed in the wall of said casing adjacent its top wall to extend tangentially to the inner cylindrical surface of said casing, the profile of said inner space being stepped in the axial section, and a portion of said profile adjacent the top wall of said casing being of a diameter which is substantially greater than the diameter of a portion thereof adjacent the open end of said casing.

6. A hammer according to claim 4, wherein said casing has an axially-extending inner cylindrical surface and wherein a through hole is formed in the wall of said casing adjacent its top wall to extend tangentially to the inner cylindrical surface of said casing, the profile of said inner space being stepped in the axial section, and a portion of said profile adjacent the top wall of said casing being of a diameter which is substantially greater than the diameter of a portion thereof adjacent the open end of said casing.

* * * * *